United States Patent [19]

Silvey et al.

[11] Patent Number: 4,528,930

[45] Date of Patent: Jul. 16, 1985

[54] STABILIZED UNDERWATER APPARATUS FOR BEING TOWED OR TETHERED

[75] Inventors: Trevor I. Silvey, Sherborne; Peter J. Merry, Yeovil, both of England

[73] Assignee: Plessey Overseas Limited, Ilford, England

[21] Appl. No.: 510,354

[22] Filed: Jul. 1, 1983

[30] Foreign Application Priority Data

Jul. 6, 1982 [GB] United Kingdom ..... 8219540

[51] Int. Cl.[3] ..... B63B 21/66

[52] U.S. Cl. ..... 114/244

[58] Field of Search ..... 114/67 R, 67 A, 90, 114/102, 103, 187, 265, 264, 243–245, 339, 340; 441/21, 22, 37; 244/130, 199, 135 A; 415/DIG. 1

[56] References Cited

U.S. PATENT DOCUMENTS

| | | | |
|---|---|---|---|
| 3,120,208 | 2/1964 | Lawrie | 114/244 |
| 3,660,807 | 5/1972 | Depew et al. | 114/243 |
| 3,999,797 | 12/1976 | Kirsch et al. | 244/130 |

*Primary Examiner*—Jesus D. Sotelo

*Attorney, Agent, or Firm*—Fleit, Jacobson, Cohn & Price

[57] ABSTRACT

Stabilized underwater apparatus (34) which is for being towed or tethered and which comprises a cylindrical body portion (40) provided with at least two stabilizers (74), the stabilizers being elongate such that they extend over a major portion of the length of the apparatus, the stabilizers being of a plate-like construction, the stabilizers extending in a plane substantially parallel to the adjacent surface of the cylindrical body portion, and the stabilizers being spaced apart from the adjacent surface of the cylindrical body portion.

8 Claims, 29 Drawing Figures

STABILIZED UNDERWATER APPARATUS FOR BEING TOWED OR TETHERED

This invention relates to stabilised underwater apparatus for being towed or tethered. More especially, this invention relates to stabilised underwater apparatus for being towed or tethered, which apparatus is formed with a cylindrical body portion.

Underwater apparatus which is for being towed or tethered and which is provided with a cylindrical body portion is well known. A cylindrical body portion is employed because it is easy to construct and it is of a shape which is suitable for withstanding hydrostatic pressure. The cylindrical shape is commonly found with marine bodies such as towed bodies, sonobuoys, moored buoys, and tethered and towed sub-surface floats. It is also known that suspended or moored cylindrical shaped bodies experience two fundamental modes of unstable motion in a water flow. Typically, these are as follows:

(1) Pendulous lateral tow-off oscillations on a towing cable, combined with roll and heading oscillations of the same frequency.

(2) The effects of vortex shedding from the bluff shape which can excite the natural roll mode of the body about some internal point.

The pendulous lateral tow-off oscillations referred to at (1) above are introduced through small asymmetries or fabrication tolerances such for example as centre of gravity, displacement or tow-point off-sets from the body's long axis. This leads to an inherent instability of the towed or tethered body in the water flow. The unstable motion tends to get worse with increasing flow velocity and, in the case of a towed body, this limits the maximum operational speed of tow. For other bodies such for example as sonobuoys or sub-surface floats, these instabilities in flow affect any internal sensors and degrade performance. For a moored buoy in a river or estuarine current, the pendulous lateral tow-off oscillations cause wear of the mooring chain and the buoy's motion may be a shipping hazard.

The effects of vortex shedding from the bluff shape, as referred to at paragraph (2) above, are caused by a well known phenomenon known as the Karman Vortex Street. This means that fluctuating flow circulations around the body lead to an oscillatory lift side force. For rigid structures such, for example as chimneys and piles, the frequency generally increases with speed. However, in the case of a free body, there is a strong tendency for the flow phenomenon to seek out and lock onto the natural roll mode frequency of the body.

It is an aim of the present invention to provide stabilised underwater apparatus which is for being towed or tethered and in which the above mentioned disadvantages are obviated or reduced.

Accordingly, this invention provides stabilised underwater apparatus which is for being towed or tethered and which comprises a cylindrical body portion provided with at least two stabilisers, the stabilisers being elongate such that they extend over a major portion of the length of the apparatus, the stabilisers being of a plate-like construction, the stabilisers extending in a plane substantially parallel to the adjacent surface of the cylindrical body portion, and the stabilisers being spaced apart from the adjacent surface of the cylindrical body portion.

Advantageously, the cylindrical body portion is provided with domed ends.

The apparatus, for example at one of the domed ends, will normally be provided with towing means. The towing means may be a towing eye or a towing bracket. The towing bracket may be pivotally secured to the cylindrical body portion.

Spacer means may be employed to space the stabilisers at a desired distance from the surface of the cylindrical body portion. The stabilisers may also extend over the ends, e.g. the domed ends, of the apparatus.

The stabilisers may each have a middle portion which is of greater width than the width of end portions of each stabiliser.

Embodiments of the invention will now be described solely by way of example and with reference to the accompanying drawings in which:

FIGS. 1*a*, 1*b*, 1*c* and 1*d* show known different types of underwater apparatus;

FIG. 2*a* shows a towed body trajectory when viewed from above;

FIG. 2*b* is a side view showing the outline of the towed body shown in FIG. 2*a;*

FIGS. 3*a* and 3*b* show vortex shedding inducing body roll, FIG. 3*a* being a rear view and FIG. 3*b* being a view from above.

FIGS. 4*a* and 4*b* show the use of a known splitter plate;

FIGS. 5*a* and 5*b* show the use of a known fin;

FIG. 5*c* shows the use of known trip wires;

FIG. 5*d* shows the use of known strakes;

Figure 11A:
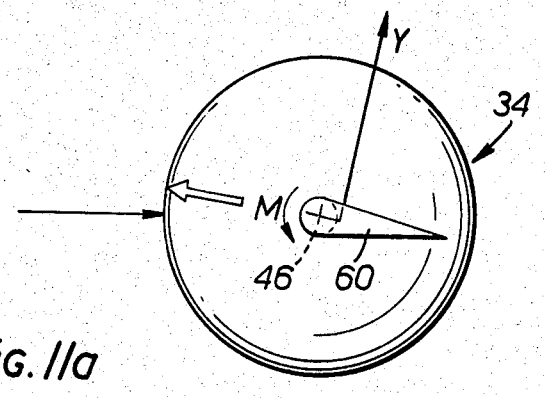
FIG. 11a PRIOR ART
Figure 11B:
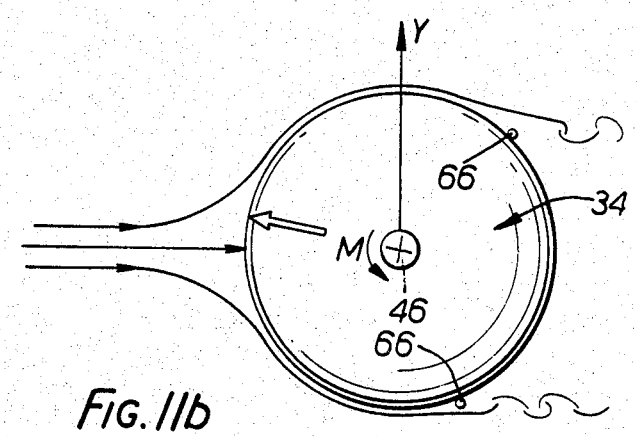
FIG. 11b PRIOR ART
Figure 11C:
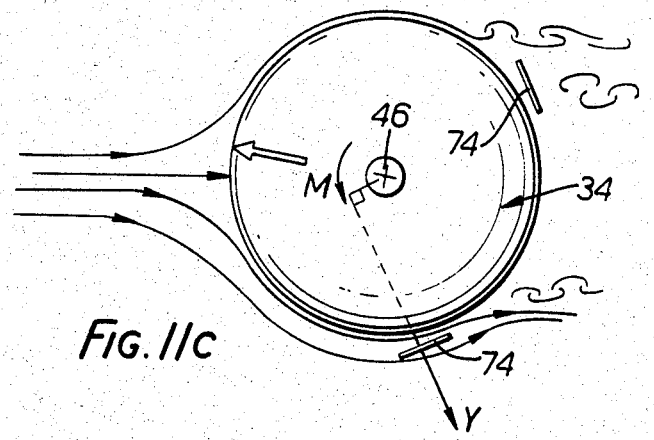
Figure 12A:
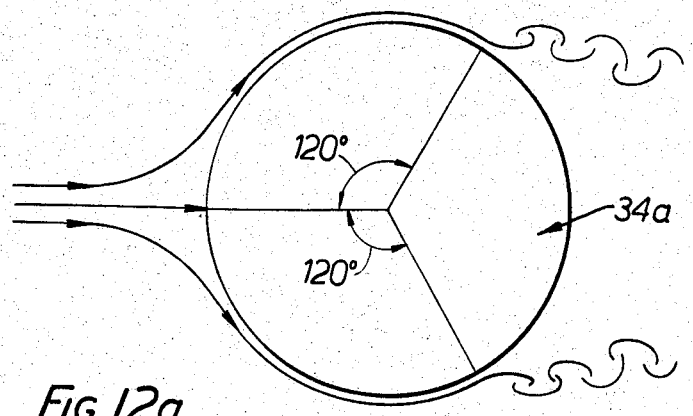
Figure 12B:
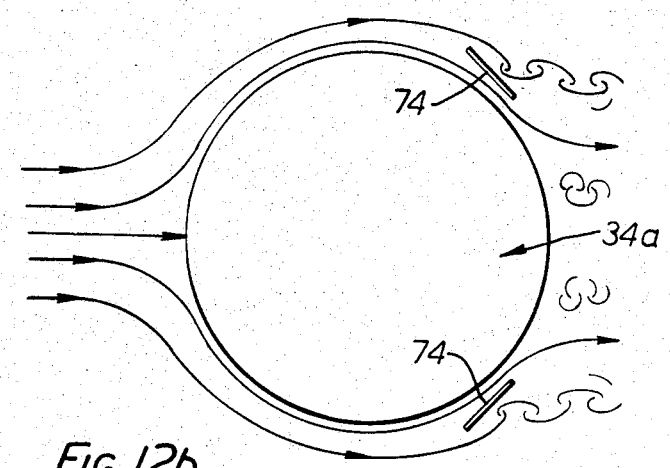
Figure 13A:
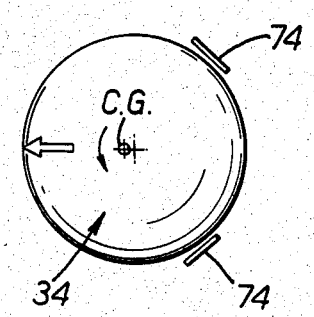
Figure 13B:
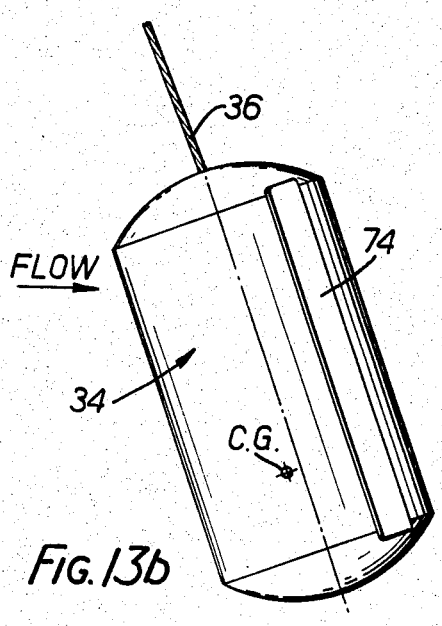
Figure 13C:
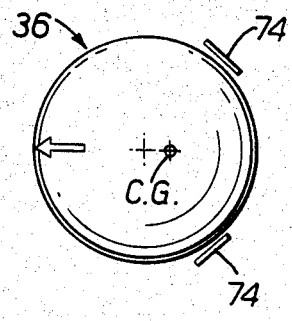
Figure 13D:
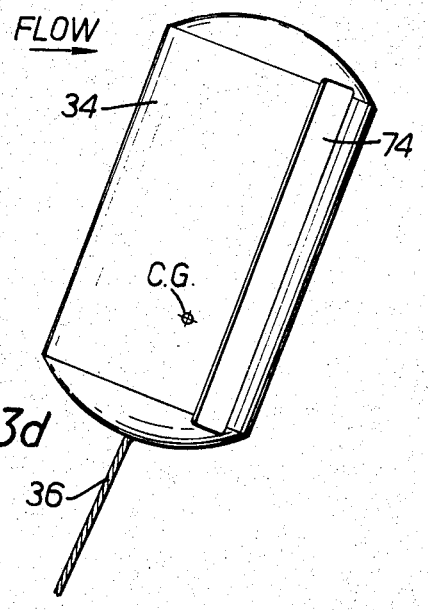
Figure 14:
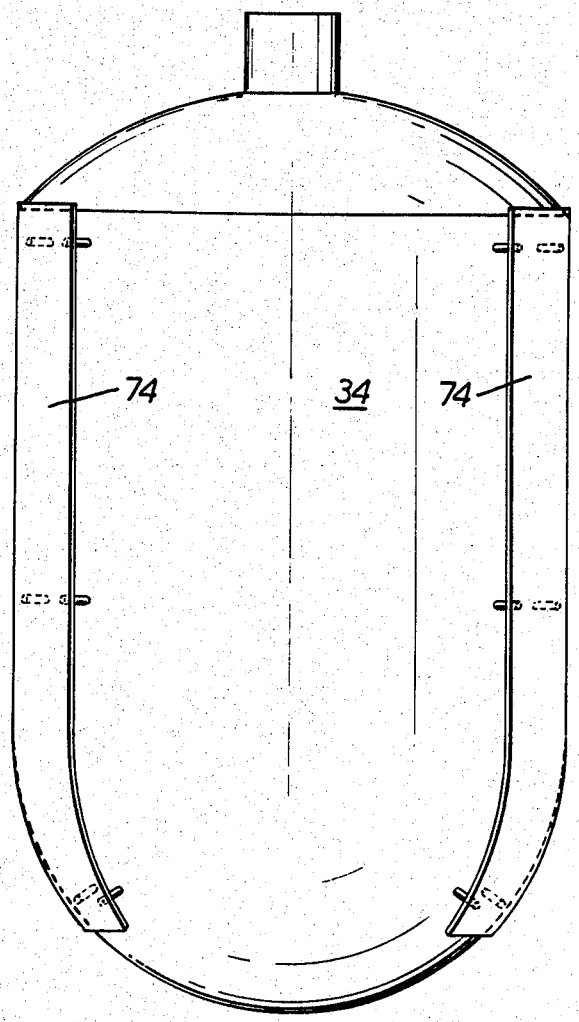

FIGS. 11*a*, 11*b* and 11*c* show forces/moments on three different marine bodies yawed in a flow;

FIGS. 12*a* and 12*b* show boundary layer separation;

FIGS. 13*a*, 13*b*, 13*c* and 13*d* show centre of gravity positions off the long axis of apparatus having a cylindrical body portion; and FIG. 14 shows an alternative apparatus of the invention.

Figure 1A:
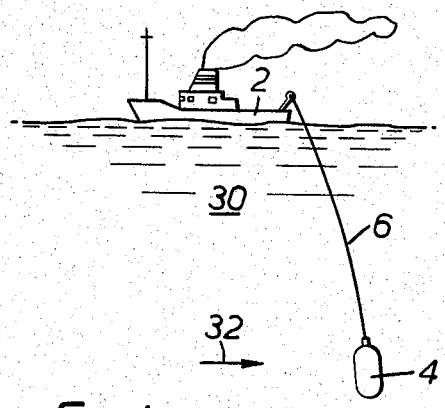
FIG. 1a PRIOR ART

Referring now to the drawings, there is shown in FIG. 1*a* a ship 2 towing a towed body 4 on a cable 6.

Figure 1B:
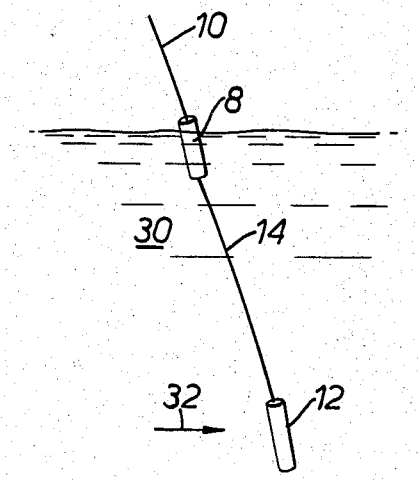
FIG. 1b PRIOR ART

In FIG. 1*b*, there is shown a sonobuoy 8 having an antenna 10. Suspended from the sonar buoy 8 is a body 12 on a cable 14.

Figure 1C:
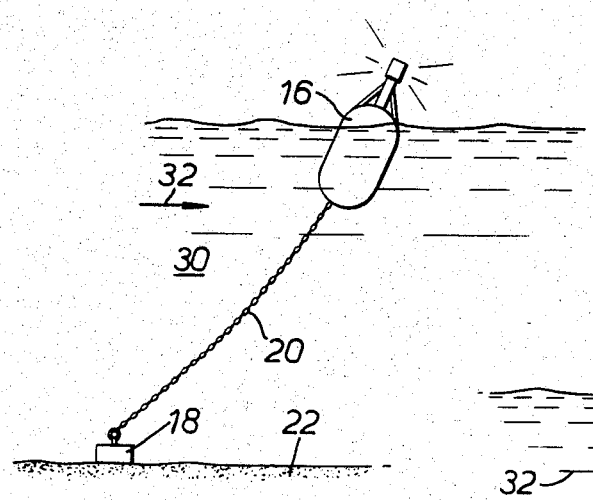
FIG. 1c PRIOR ART
Figure 1D:
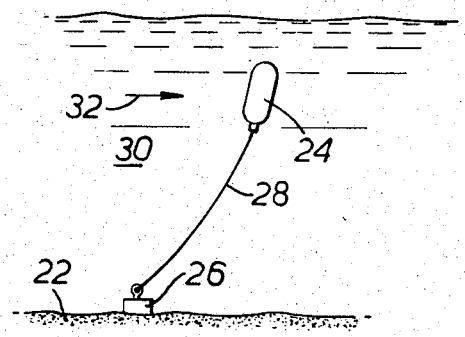
FIG. 1d PRIOR ART

In FIG. 1*c*, there is shown a moored buoy 16. The buoy 16 is moored by a weight 18 and a cable 20 to a sea or river bed 22. In FIG. 1*d*, there is shown a sub-surface float 24 moored to the sea or river bed 22 by a weight 26 and a cable 8.

The devices shown in FIGS. 1*a* to 1*d* are all known and the direction of flow of water 30 is shown in each Figure by arrow 32. It will be noted that all the bodies 4, 12, 16 and 24 have a cylindrical body portion and this cylindrical body portion is employed because it is easy to construct and it is of a shape which is suitable for withstanding hydrostatic pressure. As mentioned above, the bodies illustrated in FIGS. 1*a* to 1*d* experience two fundamental modes of unstable motion in water flow, namely (1) pendulous lateral tow-off oscillations, and (2) the effects of vortex shedding from the bluff shape, The pendulous lateral tow-off oscillations are introduced through small asymmetries or fabrication tolerances such as centre of gravity, displacement or tow-point off-sets from the body's long axis. This leads to an inherent instability of the towed or tethered body in the flow.

Figures 2A, 2B:
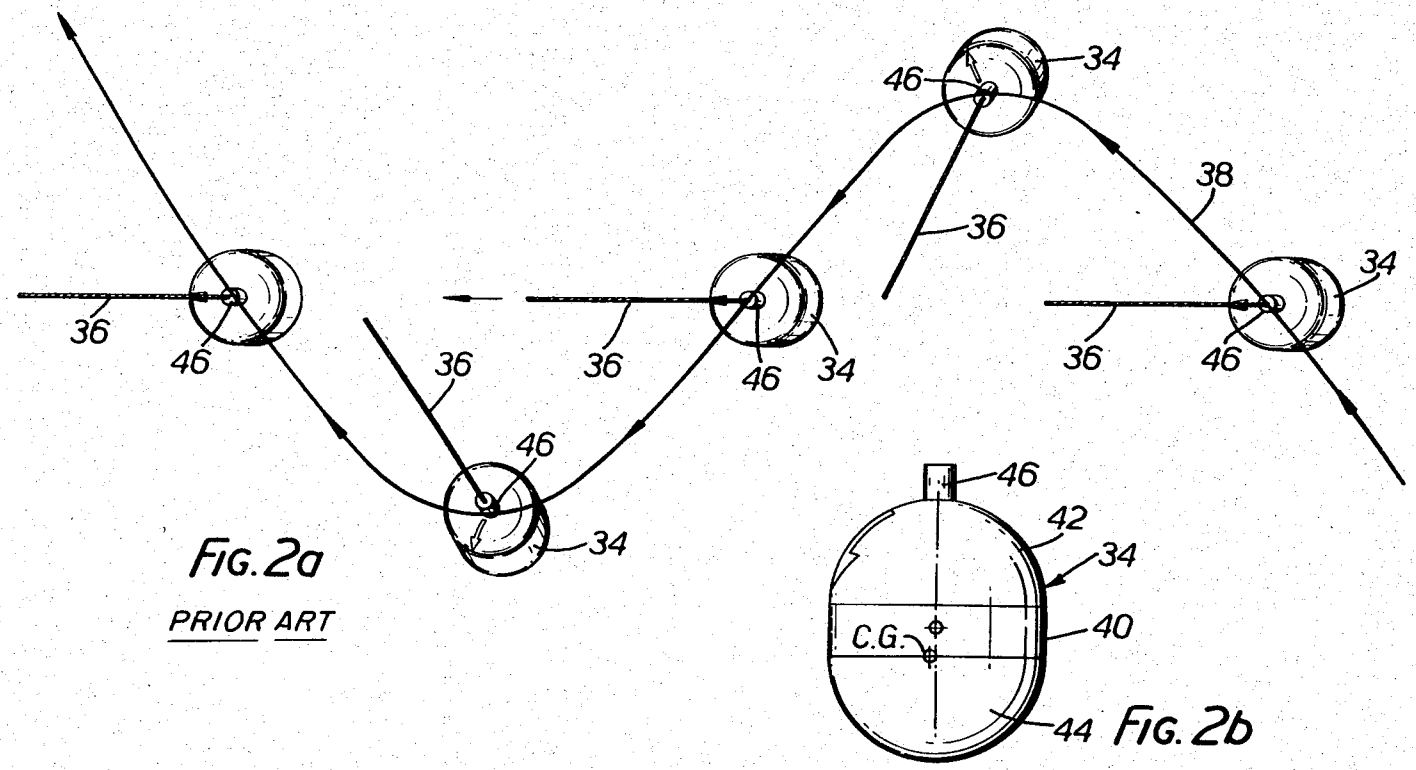
FIG. 2a PRIOR ART
FIG. 2b PRIOR ART

FIG. 2*a* shows a towed body 34 being towed by a cable 36. The unstable towing motion is illustrated by the arrowed line 38. The unstable motion illustrated by the arrowed line 38 gets worse with increasing flow velocity. In the case of the towed body 34, this limits the maximum operational towing speed. For other bodies such as sonobuoys or sub-surface floats, these instabilities in a flow field affect any internal sensors and degrade performance. For the moored buoy in a river or estuarine current, the lateral tow-off oscillations cause wear of the mooring chain and the buoy's motion may be a shipping hazard.

In FIG. 2*b*, the towed body 34 is shown having a cylindrical body portion 40 and domed ends 42, 44. The domed end 42 provided with a towing eye 46 which receives the cable 36. The towing point 46 may have an internal clamp for attaching to the cable 36.

Figure 3A:
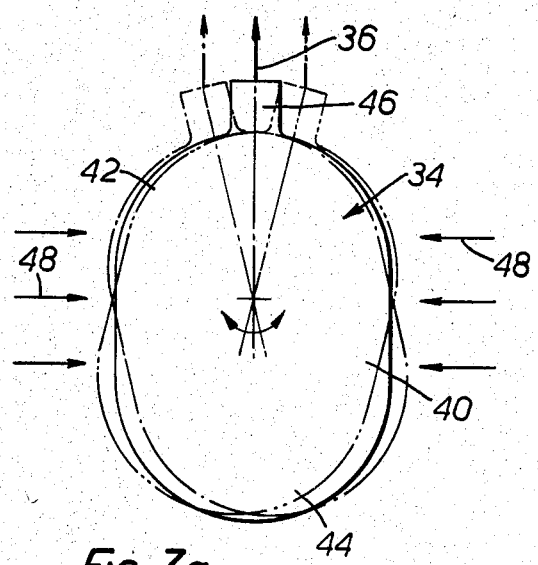
FIG. 3a PRIOR ART
Figure 3B:
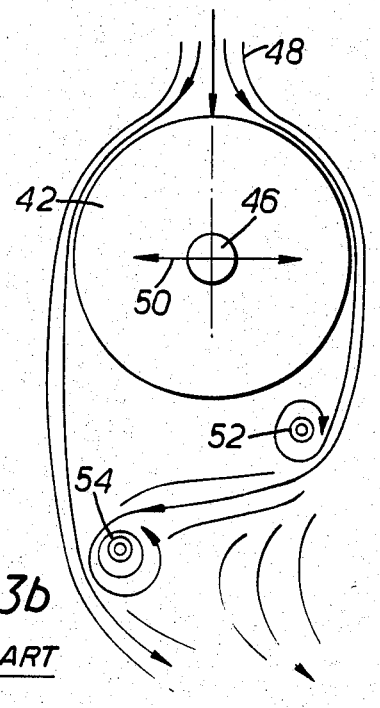
FIG. 3b PRIOR ART

It was mentioned above that the effects of vortex shedding from a bluff shape are caused by the well known phenomenon of the Karman Vortex Street, where fluctuating flow circulations around the body lead to an oscillatory lift side force. FIGS. 3*a* and FIGS. 3*b* illustrate the oscillatory lift side force on a body 34 as shown in FIGS. 2*a* and 2*b*. In FIG. 3*a*, the cable 36 translations are shown. Fluid indicated by arrows 48 suppresses body translation.

FIG. 3*b* shows the oscillating side force, this being indicated by the double headed arrow 50. Trailing Vortex Streets 52, 54 are also shown. There is a strong tendency for the flow phenomenon to seek out and lock onto the natural roll mode frequency of the body 34.

The vortex shedding behaviour can be suppressed by the addition of a splitter plate.

Figure 4A:
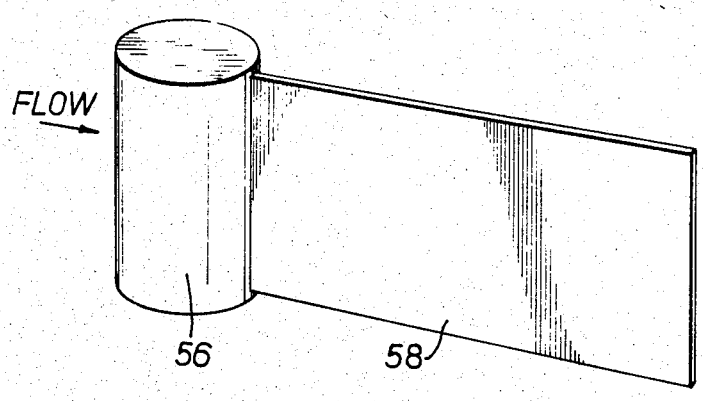
FIG. 4a PRIOR ART
Figure 4B:
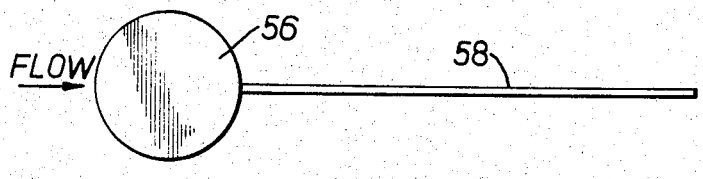
FIG. 4b PRIOR ART

FIGS. 4*a* and 4*b* show a cylindrical body 56 provided with splitter plate 58. The splitter plate 58 is rectangular in shape as shown. To be effective, the length of the splitter plate 58 needs to be at least twice the diameter of the body 56. If the splitter plate 58 is additionally to stabilise the pendulous motion, then the splitter plate 58 needs to be at least three times as long as the diameter of the body 56. It will immediately be apparent that such proportions greatly increase the overall dimensions of the entire apparatus and they are substantially unacceptable if the size of the body 56 is not to be radically altered.

Figure 5A:
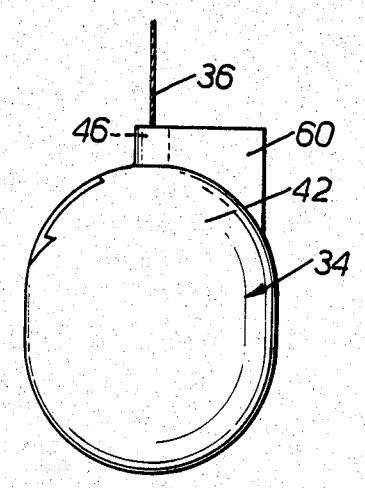
FIG. 5a PRIOR ART
Figure 5B:
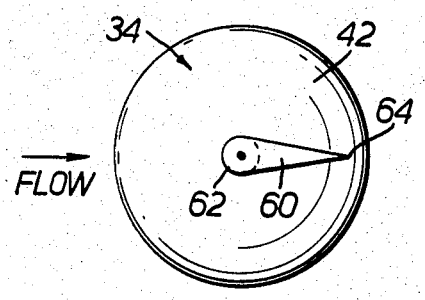
FIG. 5b PRIOR ART

An alternative to employing the splitter plate 58 illustrated in FIGS. 4*a* and 4*b*, is to employ a small fin as is illustrated in FIGS. 5*a* and 5*b*. In FIGS. 5*a* and 5*b*, there is shown the towed body 34 on its cable 36, the body 34 being provided with a fin 60. The fin is secured to the domed end 42 of the body 34 and, as shown in FIG. 5*b*, the fin 60 tapers from its leading edge 62 towards its rear edge 64. The use of the fin 60 is not successful and it drives the body 34 into a more severe lateral pendulous oscillation.

Figure 5C:
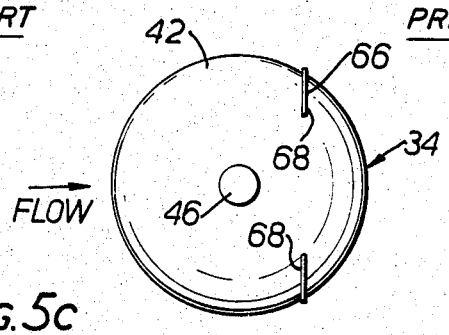
FIG. 5c PRIOR ART

A yet further alternative to the problem is to employ another small appendage in the form of two trip wires. FIG. 5*c* shows the body 34 provided with two trip wires 66. Each trip wire 66 has an end 68 which points towards the end 68 of the other trip wire 66. Each trip wire 66 travels the length of one side of the body 34 and passes particularly over the domed end 42. The trip wires 66 are beneficial for rigid structures. They are positioned just ahead of the boundary layer separation point to trigger a uniform flow separation from each side of the body 34. This prevents flow circulations around the body 34 and thus suppresses vortex shedding oscillations. When employed in the towed cylindrical body 34 application, the trip wires 66 create an imbalance in the flow separation when the body 34 yaws. This generates side forces which again drive the body 34 into a strong pendulous towing oscillation.

Figure 5D:
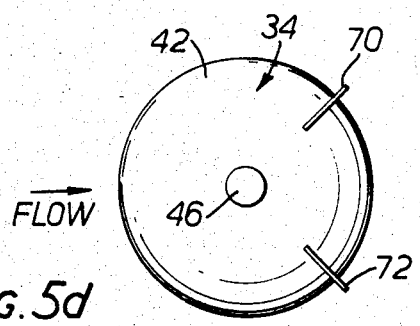
FIG. 5d PRIOR ART
Figure 6:
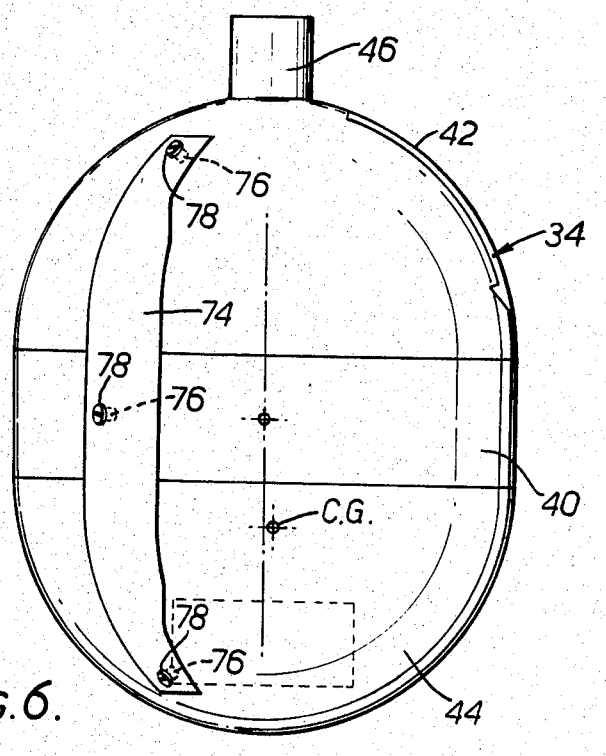
FIGS. 6 to 9 show apparatus in accordance with the invention, the apparatus having a pair of stabilisers.
Figure 7:
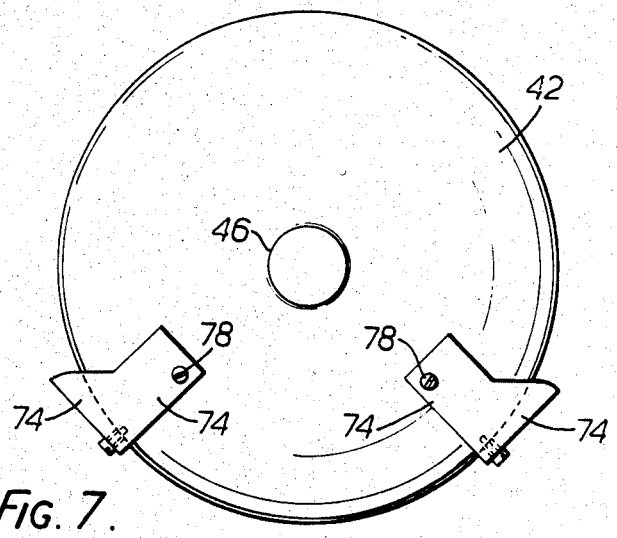
Figure 8:
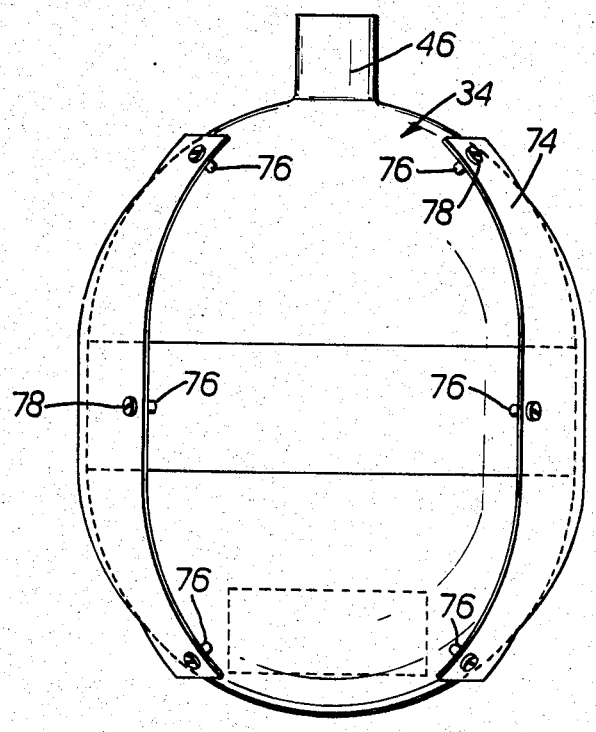
Figure 9:
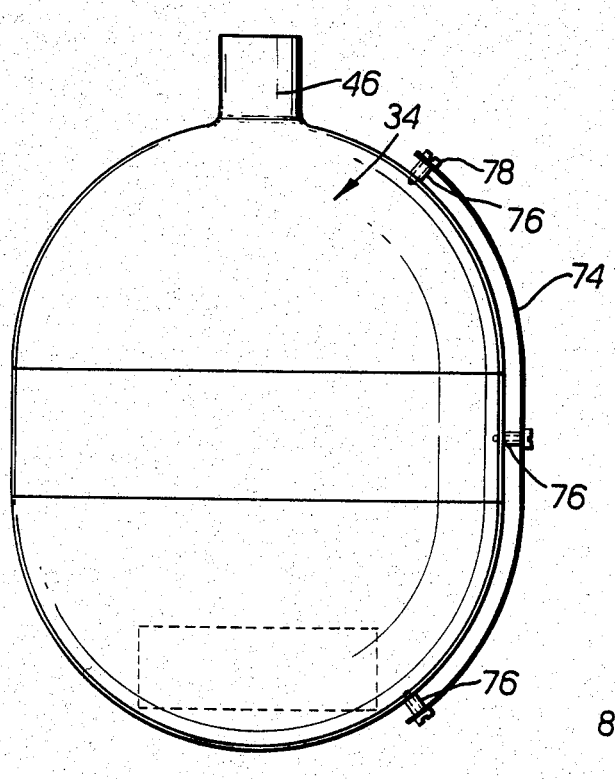

In a further alternative design to overcome the problem, a pair of thin trailing strakes may be employed. In FIG. 5*d*, there is illustrated a pair of thin trailing strakes 70, 72 attached to the body 34. The strakes 70, 72 tend to give the same problem as the trip wires 66. In addition, by encouraging an early boundary layer separation around the body 34, both the trip wires 66 and the strakes 70, 72 lead also to a thickening of the rear body wake and an undesirable increase in body drag.

The above attempts to stabilise cylindrical bodies have been so ineffective that there has been a general conclusion in the art that conventional stabilisation approaches for apparatus which is being tethered or towed and which has a cylindrical body portion are generally unacceptable, the conventional stabilisation approaches having a tendency to worsen the stability of the body. The present invention goes against this generally accepted conclusion in the art and seeks to provide a relatively simple yet effective design of stabiliser for attaching to apparatus which is being tethered or towed and which has a cylindrical body portion.

Referring now to FIGS. 6 to 9, there is shown the body 34 provided with a pair of stabilisers 74 to form the apparatus of the invention. It will be seen from FIGS. 6 to 9 and also from FIG. 10, which shows a stabiliser 74 on its own, that each stabiliser 74 is an elongate member extending from one domed end 44 to the other domed end 42 of the body 34. Each stabiliser 74 closely follows the contour of the body 34 and it is spaced apart from the body 34 by spacers 76. Screws 78 pass through apertures in the stabilisers 74 and through apertures in the spacers 76 to screw into the body 34 to secure the stabilisers 74 to the body 34. It will be seen from FIGS. 6 to 9 that the stabilisers 74 are thin and that they extend laterally around a small portion of the circumference of the body 34 so that they in effect form a second layer spaced apart from the body 34 and they do not extend over their major surface area radially away from the body 34 as in the case of the strakes 70, 72 shown in FIG. 5*d*.

Figure 10:
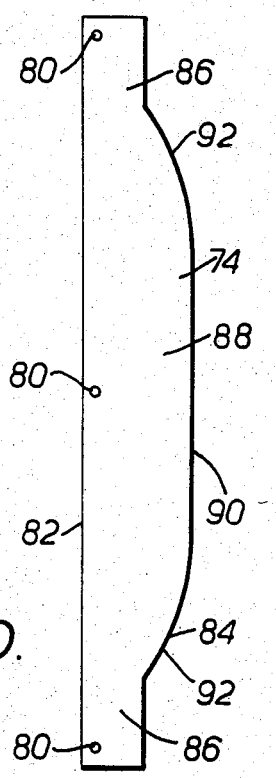
FIG. 10 shows a stabiliser on its own, the stabiliser being one as employed in the apparatus shown in FIGS. 6 to 9.

FIG. 10 shows the apertures 80 through which the screws 78 pass. FIG. 10 also shows the shape of the stabilisers 74. Thus, more specifically, it will be seen that each stabiliser 74 has a straight edge 82 and a bowed edge 84. The edge 84 is so bowed that each end 86 of the stabiliser 74 is thinner in width than the width of a middle portion 88. Each middle portion 88 has a straight edge 90 and curved end portions 92 connecting the straight edge 90 to the edges of the ends 86.

Due to the fact that the stabilisers 74 closely follow the contour of the body 34, it will be apparent that the stabilisers 74 do not in themselves occupy much space and so the body 34 can be stored in relatively confined spaces. This is particularly important where the body 34 may be required to be stored in a well in a ship. If the stabilisers 74 should be too large, they may be provided with flexible leading edges so that these flexible leading edges can be deformed to fit within the well in the ship.

For bodies of larger diameter, the gap at the leading edge of the stabilisers 74 need not be geommetrically scaled with the body dimensions. This is because the flow's boundary layer thickness does not scale directly with body size and is proportionally less for a larger body. Similar unscaled gap sizes for the full size body may allow the stabilisers to fit within the allotted space, for example in a well in a ship, without distortion.

The stabilisers 74 meet the requirement of overcoming the pendulous motion instability, giving a design which enables the body 34 to be towed in a straight line as desired. The stabilisers 74 also modify flow around the body 34 in a way which suppresses formation of the oscillating vortices which sympathise with the natural high frequency roll oscillations of the body 34 on its cable 36.

In order to emphasise the inventive significance of the present invention and the use of the stabilisers 74, reference will now be made to FIGS. 11*a*, 11*b* and 11*c*, and a comparison will be made of the stabilisers 74 with some of the above mentioned known stabiliser devices.

In FIG. 11*a*, there is shown a body 34 with a top fin 60 (see also FIGS. 5*a* and 5*b*) yawed in a flow. The fin 60 supplies a strong sideways force Y which drives the body 34 into its lateral pendulous mode of oscillation. Although there is a righting moment M to align the body 34 in a flow, the proximity of the fin 60 to the body's long axis makes this relatively small, there being only a short lever arm.

With trip wires such as shown in FIG. 11*b*, (see also FIG. 5*c*), yawing of the body 34 gives delayed separation on the leeward side and an early tripped separation on the windward side to the flow. The resulting pressure imbalance with lower pressures ahead of the trip wire 66 on the leeward side, gives a side force Y which again drives the system into unstable lateral motion. A small righting moment M arises because of the drag of the trip wire 66 which causes early separation.

The flow stabilisers 74 are designed and positioned to intentionally counter the type of instability manifested by the fin 60 and the trip wires 66. The leading edges of the stabilisers 74 are just ahead of the normal flow separation point around the circular body 34. This gives some ingress of fluid between the stabilisers 74 and the walls of the body 34. The stabilisers are set at an angle of attack to the flow, whereby their leading edge gap is greater than that at the trailing edge.

When yawed, the leeward stabiliser 74 moves more into the wake of the body 34 behind the natural flow separation region and its effectiveness is diminished. The other stabiliser 74 approaches the flow with greater effect and it gives more fluid flow through its gap, thus helping to delay separation on the windward side. Movement of the flow separation region on each side of the body 34 is in complete opposition to that of the destabilising trip wires 66. The lower stabiliser 74 illustrated in FIG. 11*c* with its enhanced flow gives a normal reaction Y in a direction which prevents the body 34 from being forced into lateral oscillations. This reaction is in an opposite direction, that is in anti-phase, to the force direction known to cause instability. The angle of attack on the stabiliser 74 puts the normal reaction force along a line ahead of the body's long access, thus effecting a moment M which additionally steers the body 34 to head back into the flow on a straight course.

Exact positioning and design of the stabilisers 74 is subject to fine tuning, but the general configuration is further illustrated in FIGS. 12*a* and 12*b*. In FIG. 12*a*, there is shown the separation regions for a plain cylinder 34 at about 120° around from the nose. FIG. 12*b* shows the stabilisers 74 with their leading edges just ahead of the separation region and the cylinder 34*a* towing straight ahead.

FIGS. 13*a* to 13*d* show how it is desirable to off-set the centre of gravity from the longitudinal axis. This additionally gives the body 34 a preferred orientation, through gravitational force and turning moment, especially at low speed, where the stabilisers 74 lose their hydrodynamic effect. For a non-buoyant body 34, the centre of gravity should be off-set towards the front of the body 34 as shown in FIGS. 13*a* and 13*b*. For a buoyant body 34, the centre of gravity should be off-set towards the body rear as shown in FIGS. 13*c* and 13*d*. When tilted in the flow, the gravitational turning moments then bring the body centre of gravity to its lowest point with the front of the body away from the stabilisers 74 facing the flow. This off-set need only be small, typically about one or two percent of a diameter and it can be achieved by suitable ballasting.

The apparatus of the invention is particularly suitable as a deployable body from a centre well of a ship, the well running vertically upwards through the hull of the ship. Such an arrangement allows the apparatus to be partially retracted into the ship's hull to act as a hull-mounted sonar, or to be deployed below the ship on a cable. The design of the apparatus of the invention eliminates problems of recovery through the air/water interface as might occur with systems towed from the stern of the ship. Further retraction of the towed apparatus up into the well, brings the apparatus to an inboard maintenance area. The centre-well deployable system may be integrated into the vessel and may be fully automatic and operable from the bridge of the ship, without the need for hands on deck to man-handle or maintain the equipment. The cylindrical shaped body is relatively insensitive to ship's motion, because its mass centre is close to the axis and there are no appendages distant from the tow point which can react to make the body pitch, yaw and roll in response to ship motion. The cylindrical body has the shape most easily retracted into the ship's well and it maximises the volume available within the body, for example for sonar arrays. This has important benefits on performance.

In the case of a towed sonar device, the device may be provided with a plastic sonar dome which surrounds motion compensated and steerable sonar transducer arrays in a flooded lower part of the apparatus. At the top of the apparatus there may be provided a water tight compartment containing electronic equipment. Lead ballast may be installed at the base of the body 34 so as not to obstruct the accoustic path of a sonar scan.

FIG. 14 shows an alternative design of apparatus for the invention in which the stabilisers 74 are straighter and do not have the bowed middle portions. The stabilisers 74 are still thin. They are fitted close to the body 34 and they can be fitted without seriously interferring with the retraction of the body 34 into a desired space for deck storage and recovery.

It is to be appreciated that the embodiments of the invention described above have been given by way of example only and that modifications may be effected.

We claim:

1. A stabilized underwater apparatus to be towed or tethered in water, said stabilized underwater apparatus including:

a body including a cylindrical body portion;

at least two plate-like elongate stabilizers for stabilizing the movement of the body through water, each stabilizer including a leading edge for ingress of water between the leading edge and said cylindrical body portion and a trailing edge for egress of water between the trailing edge and said cylindrical body portion and each stabilizer extending over a major portion of the length of said body;

spacer means for spacing the at least two stabilizers from the surface of said cylindrical body portion;

a gap defined between the trailing edge and the adjacent surface of the cylindrical body portion; and a gap defined between the leading edge and the adjacent surface of the cylindrical body portion being greater than said gap defined between the trailing edge and the adjacent surface of the cylindrical body portion.

2. Stabilised underwater apparatus according to claim 1 in which the cylindrical body portion is provided with domed ends.

3. Stabilised underwater apparatus according to claim 1 which is provided with towing means.

4. Stabilised underwater apparatus according to claim 3 in which the towing means is a towing eye.

5. Stabilised underwater apparatus according to claim 3 in which the towing means is a towing bracket.

6. Stabilised underwater apparatus according to claim 5 in which the towing bracket is pivotally mounted on the cylindrical body portion.

7. Stabilised underwater apparatus according to claim 1 in which the stabilisers also extend over the ends of the apparatus.

8. Stabilised underwater apparatus according to claim 7 in which the stabilisers each have a middle portion which is of greater width than the width of end portions of each stabiliser.

* * * * *